United States Patent [19]

Darlington

[11] 4,200,079

[45] Apr. 29, 1980

[54] ENGINE OIL PRESSURE OPERATED SYSTEM

[75] Inventor: Jack Darlington, Southampton, England

[73] Assignee: Petter Power Generation Limited, Hamble, England

[21] Appl. No.: 914,613

[22] Filed: Jun. 9, 1978

[30] Foreign Application Priority Data

Jun. 9, 1977 [GB] United Kingdom ..... 24165/77

[51] Int. Cl.[2] ..... F02N 17/00; F01L 13/08

[52] U.S. Cl. ..... 123/179 G; 123/179 L; 123/139 ST; 123/182

[58] Field of Search ..... 123/179 L, 179 G, 139 ST, 123/182

[56] References Cited

U.S. PATENT DOCUMENTS

| | | | |
|---|---|---|---|
| 2,741,186 | 4/1956 | Nallinger | 123/179 L |
| 3,223,076 | 12/1965 | Isoda | 123/182 |
| 3,311,101 | 3/1967 | Huse | 123/179 L |
| 3,614,946 | 10/1971 | Staudt et al. | 123/179 L |

FOREIGN PATENT DOCUMENTS

| | | | |
|---|---|---|---|
| 1068607 | 5/1967 | United Kingdom | 123/179 L |
| 1103919 | 2/1968 | United Kingdom | 123/179 L |
| 1109387 | 4/1968 | United Kingdom | 123/179 L |
| 1352093 | 5/1974 | United Kingdom | 123/179 L |

*Primary Examiner*—Charles J. Myhre
*Assistant Examiner*—M. Moy
*Attorney, Agent, or Firm*—Wigman & Cohen

[57] ABSTRACT

For starting a compression-ignition internal combustion engine, a solenoid valve is electrically energized simultaneously with the starter motor (the valve remaining electrically energized while the engine afterwards continues to run) to supply oil pressure from the engine oil pump to a first piston-in-cylinder device to move a fuel injection pump lever from "stop" to "run" against a first return spring, so that fuel supply always (even when starting) depends upon adequate oil pressure. A second piston-in-cylinder device with a second return spring is responsive after a delay to the oil pressure to change the engine from at least partial decompression to full compression.

7 Claims, 1 Drawing Figure

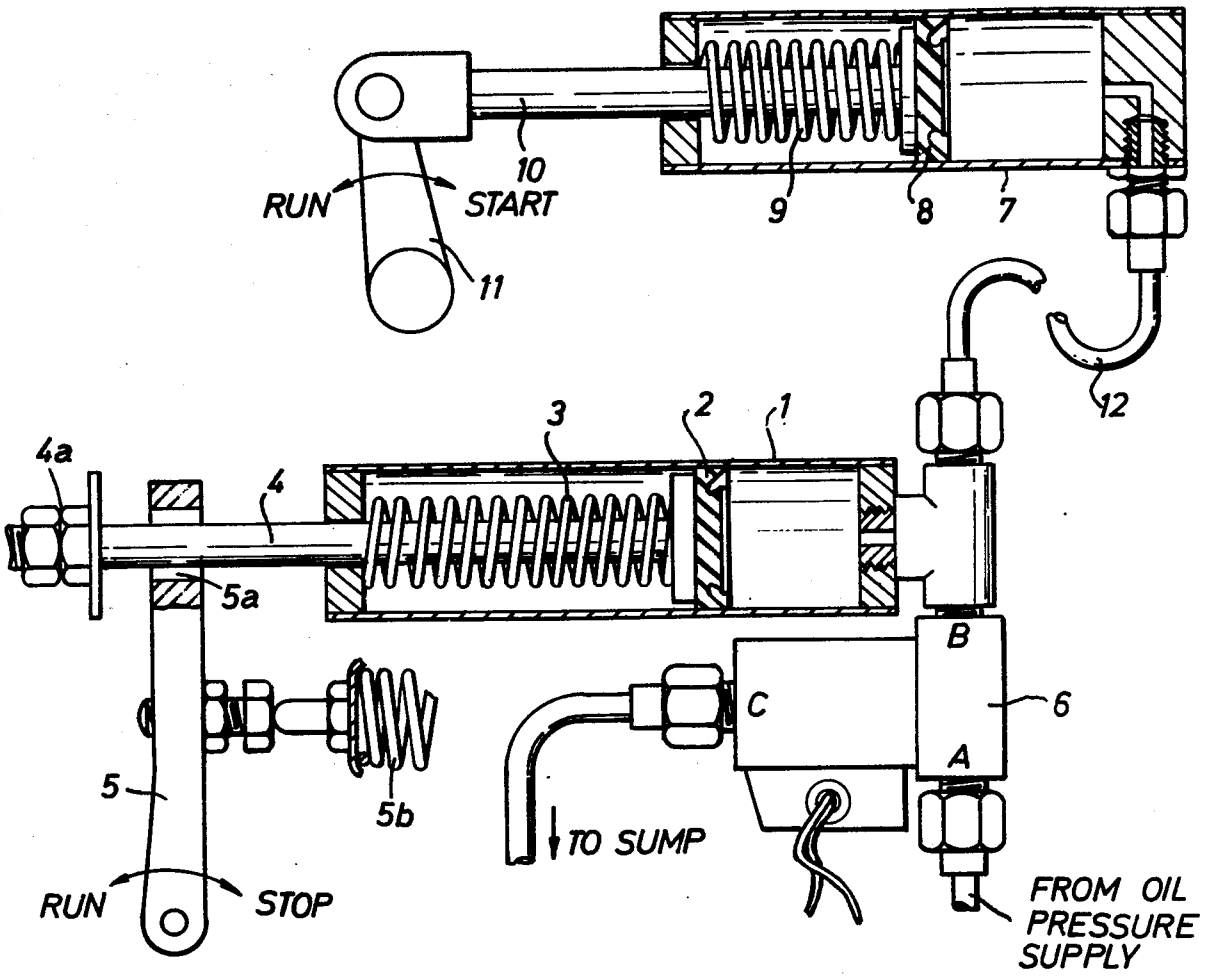
FROM OIL PRESSURE SUPPLY
TO SUMP
STOP
RUN
START
RUN
A
B
C
1
2
3
4
4a
5
5a
5b
6
7
8
9
10
11
12

ENGINE OIL PRESSURE OPERATED SYSTEM

FIELD OF THE INVENTION

This invention relates to an engine oil pressure-operated system for starting and stopping of a compression-ignition internal combustion engine by moving a control member of a fuel injector pump of the engine respectively to a "run" position and a "stop" position, and/or for changing automatically from partial or complete decompression to complete compression of an internal combustion engine.

DESCRIPTION OF PRIOR ART

The prior art known to me comprises British Patent specifications Nos. 990,072, 1,035,976, 1,068,607, 1,103,919, 1,109,387, 1,136,761, 1,237,842, 1,352,003 and 1,352,093.

SUMMARY OF THE INVENTION

As seen from one aspect of the invention, there is provided an engine oil pressure-operated system for starting and stopping of a compression-ignition internal combustion engine by moving a control member of a fuel-injector pump of the engine respectively to a "run" position and a "stop" position, comprising an oil pressure-operated device connected to the control member and operable by oil pressure from the engine to move the control member to the "run" position against a return spring which is operative in the absence or upon removal of oil pressure from said device to move the control member to the "stop" position, and valve means selectively operable firstly to supply oil pressure from the engine to said device and secondly to alternatively connect said device to drain.

Preferably said valve means is an electrically operable three-way solenoid valve.

Preferably the connection to drain is a connection to the engine sump.

If the engine is of a type adapted to be partially or completely decompressed during starting, said system may include a second oil pressure-operated device connected to a second control member and responsive to oil pressure via said valve means to move the second control member from a partial or complete decompression position to a complete compression position with a delay after the first-mentioned device has moved the first-mentioned control member to its "run" position.

Preferably a second return spring is operative to move the second control member to the partial or complete decompression position in the absence or upon removal of oil pressure from said second device.

As seen from another aspect of the invention, there is provided an engine oil pressure-operated system for changing automatically from partial or complete decompression to complete compression of an internal combustion engine, comprising an oil pressure operated piston-in-cylinder device connected to an engine compression-control member and arranged to be supplied with oil from the engine so as to be responsive to oil pressure from the engine to move the control member from a partial or complete decompression position to a complete compression position.

IN THE DRAWINGS

The single FIGURE is a partly sectioned drawing of a preferred form of engine oil pressure-operated system embodying both aspects of the invention.

DESCRIPTION OF THE PREFERRED EMBODIMENT

Referring to the drawing, the illustrated system is adapted for use with a range of compression ignition internal combustion engines which are available from Petters Limited and which are known as the PH/PJ single and twin cylinder diesel engines. The illustrated system comprises a cylinder 1 containing a piston with an oil seal 2 and a return spring 3. An operating rod 4 is connected to the piston and extends movably through a hole **5*a* in a pivoted governor arm 5 to allow a speeder/-governor spring 5*b* of the engine to move the governor arm 5 to a "run" position when the rod 4 has been extended out of the cylinder 1 in a manner to be described. The rod 4 is fitted with a lock-nut and washer assembly 4*a* for moving the arm 5 positively to a "stop" position when the rod 4 retracts into the cylinder in a manner to be described. The cylinder 1, piston-with-oil 2, return spring 3 and piston rod 4 are manufactured by Schrader Limited and are available as an assembly known as their Part No. 44828, one inch (1") diameter, neck mounted, suitable for use with oil. The governor arm 5 is part of the engine and forms a control member of one or two fuel injector pumps (not shown) of the engine—according to the number of cylinders—the arm 5 being movable to the "run" position and the "stop" position as desired. The cylinder 1 is arranged to be supplied with engine oil pressure via a three way solenoid valve 6 having three ports A, B, and C. The solenoid valve 6 is manufactured by Alpha Controls Limited to their type reference SIRAI, Ref. No. L 3332/5, ¼" BSP (British Standard Pipe) entry ports (i.e., ports A and B in the drawing), ⅛" BSP vent port (i.e., port C) body orifice 3 millimeters, operating pressure 4.5 bar, suitable for use with oil. The valve 6, when energised electrically, opens port A to port B and closed port C. When the valve 6 is unenergised, port C is opened to port B while port A is closed. The oil pressure supply from the engine is connected to port A. Port B is connected to cylinder 1** whilst port C is connected to the crankcase, sump or lubricating oil tank of the engine (not shown).

A second cylinder 7 contains a second piston with an oil seal 8 and a return spring 9. An operating rod 10 is connected to the piston 8 and also to a second control arm 11. The cylinder 7 is connected by a pipe 12 to the port B of valve 6. The control arm 11 is also part of the engine and can be moved selectively to a "start" position to cause partial or complete decompression of the engine, by opening the exhaust valve or valves, to permit easy starting of the engine, or to a "run" position to apply complete compression to the engine. The cylinder 7, piston-with-oil seal 8, return spring 9 and operating rod 10 are manufactured by Schrader Limited to their Part No. 40410 AV, 1" diameter, trunnion mounted, suitable for use with oil.

When the arm 5 is rotated clockwise by movement of control rod 4 to the right as seen in the drawing, the supply of fuel from the injector pump to each cylinder of the compression-ignition engine is cut off, stopping the engine. Movement of the control rod 4 to the left enables spring **5*b* to rotate arm 5** counterclockwise and hence enables the injector pump to supply fuel to each engine cylinder.

Movement of operating rod 10 to the right, rotating arm 11 clockwise, causes the application of partial or complete decompression of the engine, by opening the exhaust valve or valves, to permit easy starting of the engine. Movement of operating rod 10 to the left, rotating arm 11 counterclockwise, applies complete compression to the engine.

Because of the provision of the pipe 12, when oil pressure is supplied by valve 6 to cylinders 1 and 7, movement of operating rod 4 to the left takes place before movement of rod 10 to the left, with the result that fuel is supplied to each engine cylinder, while partial or complete decompression is still applied to the engine.

In operation, the solenoid valve 6 is energised (by means not shown) simultaneously with operation of an electric starter motor (not shown) for cranking the engine. The solenoid valve 6 remains energised for as long as the engine is required to run. As the engine is motored or cranked on the starter motor, oil pressure builds up and feeds via port A through to port B and so to the cylinder 1. When the pressure is sufficient to overcome the force of the return spring 3, the piston 2 moves the operating rod 4 to the left and hence rotates the control arm 5 counterclockwise to the "run" position, enabling fuel to be supplied to each engine cylinder. Soon afterwards, the oil pressure causes the piston 8 to move the operating rod 10 to the left, rotating arm 11 counterclockwise to apply complete compression to the engine, to start the engine running.

When it is required to stop the engine, whether because of a fault or for any other reason, the valve 6 is de-energised, closing port A and opening port B to port C, so that piston 2 and operating rod 4 are moved to the right by the compression spring 3, rotating arm 5 clockwise to the "stop" position in which fuel supply to each engine cylinder from the injector pump is shut off. After a short delay, due to the restriction of pipe 12, the compression spring 9 moves the piston 8 and the operating rod 10 to the right, rotating arm 11 clockwise to its "start" position, in which partial or complete decompression is applied to the engine in readiness for the next time of starting of the engine.

The system provides protection against loss of oil pressure, since failure of the oil pressure supply will result in the spring 3 moving piston 2 and rod 4 to the right, rotating arm 5 clockwise and shutting off the fuel supply. Similarly, the engine cannot be started unless it has sufficient oil to provide the necessary oil pressure to move both pistons 2 and 8 and operating rods 4 and 10 to the left.

In a modification for use with a compression ignition engine not requiring partial or complete decompression for starting, the cylinder 7, piston 8, spring 9, operating rod 10, arm 11 and pipe 12 may be omitted, provided that the connection of the pipe 12 to the cylinder 1 is closed off in order to avoid loss of oil.

In another modification, the cylinder 7, piston 8, spring 9, operating rod 10 and arm 11 can be used without the cylinder 1, piston 2, spring 3, operating rod 4, arm 5 and valve 6, by connecting the pipe 12 directly to the oil pressure supply. In this case, when cranking the engine by hand, the spring 9 causes the engine initially to be partially or completely decompressed. Then, during cranking, the oil pressure builds up so as automatically to move piston 8 and rod 10 to the left, rotating arm 11 counter-clockwise to apply complete compression to the engine, to start the engine running. Other compression ignition internal combustion engines may require a different cylinder diameter and/or piston stroke for operating the fuel pump control member and/or the compression control member if provided, or even a different solenoid valve.

It is a matter of choice, how long a time delay is required after moving arm 5 to "run" before moving arm 11 to "run".

What is claimed is:

1. In a compression-ignition internal combustion engine which includes a fuel-injector pump having a control member which is selectively operable to a "run" position and a "stop" position such that fuel is injected into at least one engine cylinder in the "run" position of the control member and such that no fuel is injected into the at least one engine cylinder in the "stop" position of the control member, the engine also including an oil pump for pumping lubricating oil under pressure around the engine, the provision of an engine oil pressure-operative system for starting and stopping of said compression-ignition internal combustion engine by moving said control member of said fuel injector pump respectively to said "run" position and said "stop" position, comprising:

an oil pressure-operative device connected to the control member and arranged to be supplied with oil from the engine so as to be responsive to oil pressure from said engine in order to move the control member to the "run" position;

the system including a return spring which is operative absent oil pressure from said device to move the control member to the "stop" position; and valve means selectively operable firstly for supplying oil pressure from the oil pump to said device and secondly for alternatively connecting said device to drain.

2. A system as recited in claim 1 in which said valve means is an electrically operable three-way solenoid valve.

3. A system as recited in claim 1 in which the valve means for alternatively connecting said device to drain is connected to an engine sump.

4. In a compression-ignition internal combustion engine which includes a fuel-injector pump having a first control member which is selectively operable to a "run" position and a "stop" position such that fuel is injected into at least one engine cylinder in the "run" position of said first control member and such that no fuel is injected into the at least one engine cylinder in the "stop" position of said first control member, the engine also including an oil pump for pumping lubricating oil under pressure around the engine, the engine further including a second control member which is selectively operable to a "start" position and to a "run" position and engine compression-controlling means responsive to said second control member to apply at least partial decompression to the engine in response to said second control member being in its "start" position and to apply full compression to the engine in response to said second control member being in its "run" position, the provision of an engine oil pressure-operated system for starting and stopping of said compression ignition internal combustion engine by moving said first control member of said fuel injector pump respectively to its "run" position and its "stop" position, comprising:- a first oil pressure operated device connected to said first control member and operable by oil pressure to move said first control member to its "run" position; said first device including a first return spring which is operative absent oil pressure from said first device to move said first control member to its "stop" position; valve means selectively operable firstly to supply oil pressure from the oil pump to said first device and secondly to alternatively connect said first device to drain and a second oil pressure-operated device connected to said second control member and responsive to oil pressure from the oil pump via said valve means to move said second control member from its "start" position to its "run" position with a delay after said first device has moved said first control member to its "run" position.

5. A system as recited in claim 4 in which said valve means is an electrically operable three-way solenoid valve.

6. A system as recited in claim 4 in which the connection to drain is a connection to an engine sump.

7. A system as recited in claim 4 in which there is provided a second return spring operative to move the second control member to its "start" position absent oil pressure from said second device.

* * * * *